US010702106B2

(12) United States Patent
Green et al.

(10) Patent No.: US 10,702,106 B2
(45) Date of Patent: Jul. 7, 2020

(54) DISPENSER FOR ROLLED MATERIALS

(71) Applicant: Umbra LLC, Buffalo, NY (US)

(72) Inventors: David Green, Toronto (CA); Dominic Marco Montante, Toronto (CA)

(73) Assignee: Umbra LLC, Buffalo, NY (US)

( * ) Notice: Subject to any disclaimer, the term of this patent is extended or adjusted under 35 U.S.C. 154(b) by 52 days.

(21) Appl. No.: 16/208,720

(22) Filed: Dec. 4, 2018

(65) Prior Publication Data

US 2020/0170459 A1 Jun. 4, 2020

(51) Int. Cl.

| | |
|---|---|
| ***A47K 10/38*** | (2006.01) |
| ***B65H 16/00*** | (2006.01) |
| ***B65H 35/00*** | (2006.01) |
| ***A47K 10/32*** | (2006.01) |

(52) U.S. Cl.

CPC ..... *A47K 10/38* (2013.01); *B65H 16/005* (2013.01); *B65H 35/002* (2013.01); *A47K 2010/3233* (2013.01)

(58) Field of Classification Search

CPC ..... A47K 10/38; A47K 2010/3233; B65H 16/005; B65H 35/002

See application file for complete search history.

(56) References Cited

U.S. PATENT DOCUMENTS

| | | | | |
|---|---|---|---|---|
| 2,300,869 | A * | 11/1942 | Brandes, Jr. | B21C 47/30 242/575.5 |
| 3,118,631 | A * | 1/1964 | Soucy | A43D 43/06 242/422.3 |
| 6,793,097 | B2 | 9/2004 | Kamenstein | |
| 7,104,418 | B2 | 9/2006 | Kamenstein | |
| 7,543,776 | B2 * | 6/2009 | Kurzyniec | B65D 85/04 242/423 |
| 7,997,523 | B1 * | 8/2011 | Taugner | B65H 49/28 242/406 |
| 9,730,560 | B2 * | 8/2017 | Flocchini | A47K 10/3836 |
| 2002/0066822 | A1 * | 6/2002 | Emes | B65H 49/28 242/597.7 |
| 2005/0056718 | A1 * | 3/2005 | Kamenstein | A47K 10/3836 242/422.4 |
| 2007/0262191 | A1 * | 11/2007 | Amron | A47K 10/3836 242/597.7 |
| 2011/0233255 | A1 * | 9/2011 | Tiamson | A47K 10/3836 225/77 |

* cited by examiner

*Primary Examiner* — William A. Rivera
(74) *Attorney, Agent, or Firm* — Simpson & Simpson, PLLC; Michael Nicholas Vranjes

(57) ABSTRACT

A dispenser for rolled materials, including a first base, a second base rotatably engaged with the first base, the second base including a disc including a top surface having one or more ribs arranged thereon, and a vertical member connected to the top surface, a first post connected to the first base, and a second post connected to the first base, the second post including a flapper operatively arranged to engage the one or more ribs.

20 Claims, 8 Drawing Sheets

DISPENSER FOR ROLLED MATERIALS

FIELD

The present disclosure relates to holders for paper, plastic, foil, and other goods arranged on rolls or tubes, and more particularly, to dispensers for paper, plastic, foil, and other goods supplied as sheets on rolls or tubes.

BACKGROUND

A number of household paper, plastic, and foil goods are commonly supplied as continuous sheets on a roll or tube. Some examples of these goods are paper towels, toilet paper, plastic wrap, wax paper, aluminum foil, wrapping paper, and garbage bags. Often, the sheets are perforated at regular intervals to allow an individual to select a desired quantity of material and easily separate it from the roll. Dispensing of these materials is made even easier by a variety of dispensing devices that are used to mount the roll or tube on a dowel or rod to allow the sheets to easily be unraveled from the roll. However, one drawback of known dispensers is that because the roll of product is allowed to rotate freely, the force required to separate individual sheets from the roll frequently results in excess material being unraveled from the roll.

Thus, there is a long felt need for a dispenser for rolled paper, plastic, foil, or other products that restricts rotation of the roll to eliminate excess material being unraveled therefrom.

SUMMARY

According to aspects illustrated herein, there is provided a dispenser for rolled materials, comprising a first base, a second base rotatably engaged with the first base, the second base including a disc including a top surface having one or more ribs arranged thereon, and a vertical member connected to the top surface, a first post connected to the first base, and a second post connected to the first base, the second post including a flapper operatively arranged to engage the one or more ribs.

According to aspects illustrated herein, there is provided a dispenser for a roll of material having an inner tube and material wrapped around the inner tube, the dispenser comprising a first base including a recessed surface, a second base rotatably engaged with the first base, the second base including a disc including a top surface having one or more ribs arranged thereon and a bottom surface arranged on the recessed surface, a vertical member connected to the top surface and arranged to be non-rotatably connected to the inner tube, and a first through-bore, a first post extending through the first through-bore and connected to the first base, and a second post connected to the first base, the second post including a flapper operatively arranged to engage the one or more ribs, wherein the top surface is axially arranged between the flapper and the recessed surface.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required. By "rotatably connected" elements, we mean that the elements are rotatable with respect to each other.

Figure 1A:
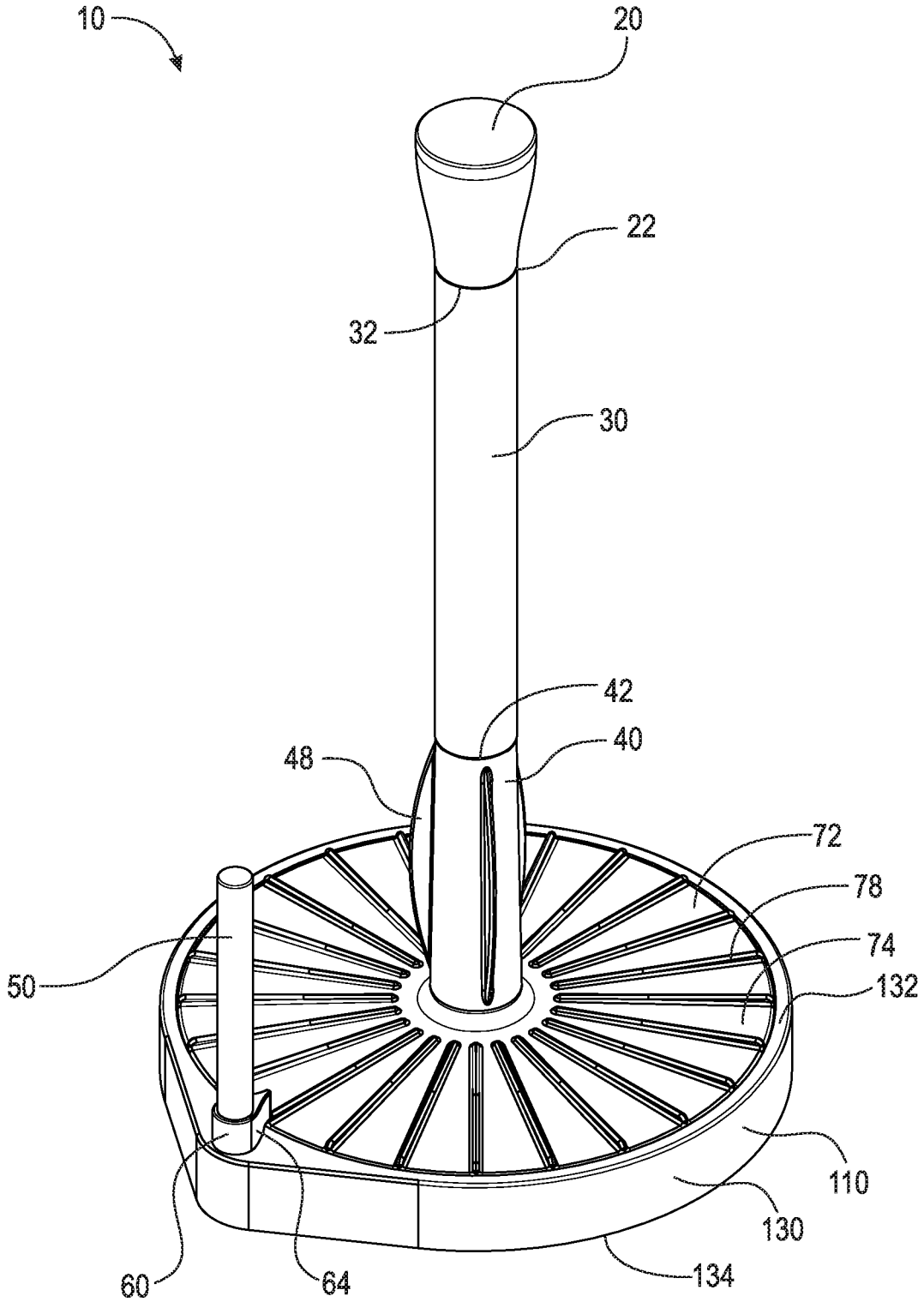
FIG. 1A is a top perspective view of a dispenser.
Figure 1B:
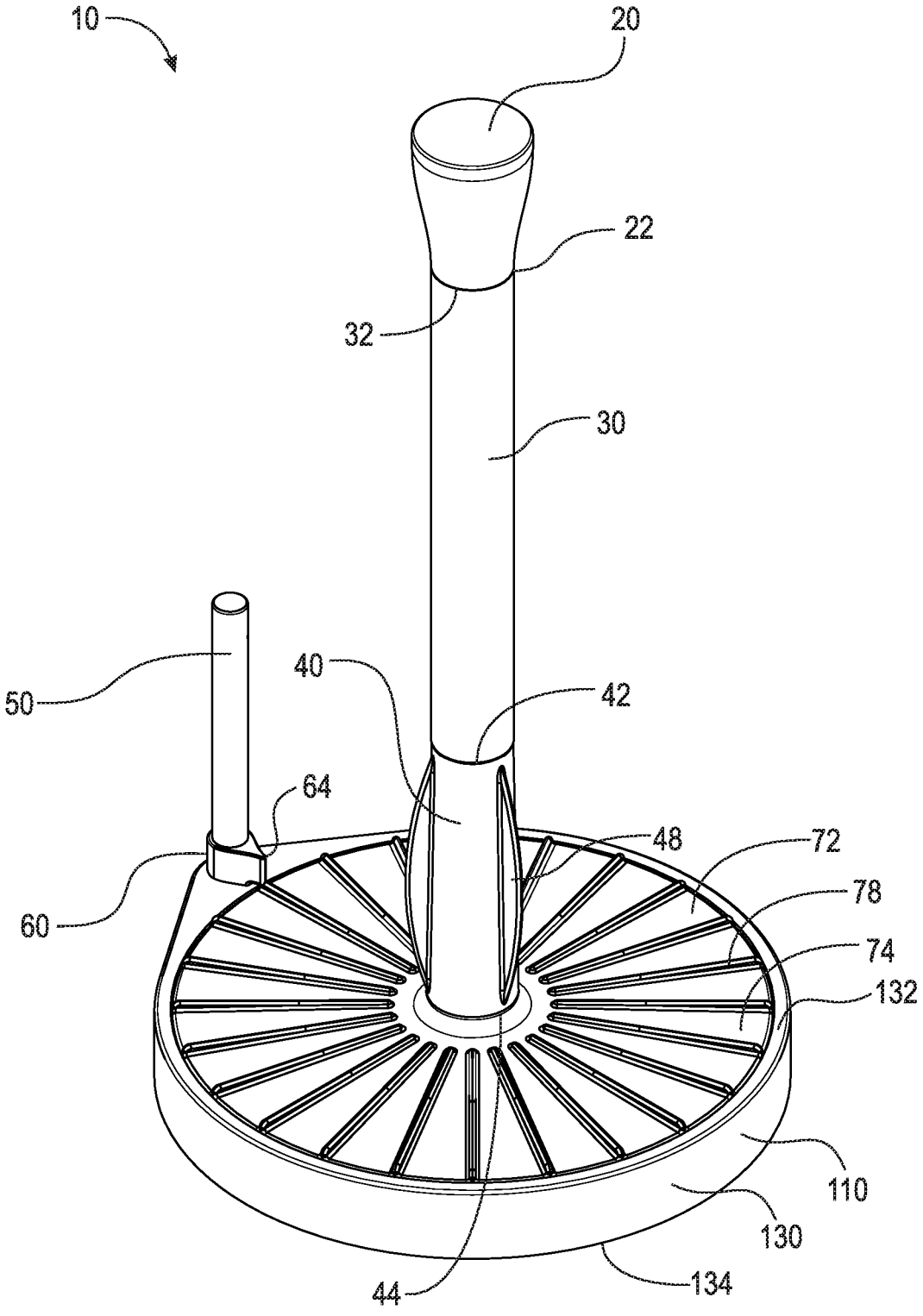
FIG. 1B is a top perspective view of the dispenser shown in FIG. 1A.
Figure 2:
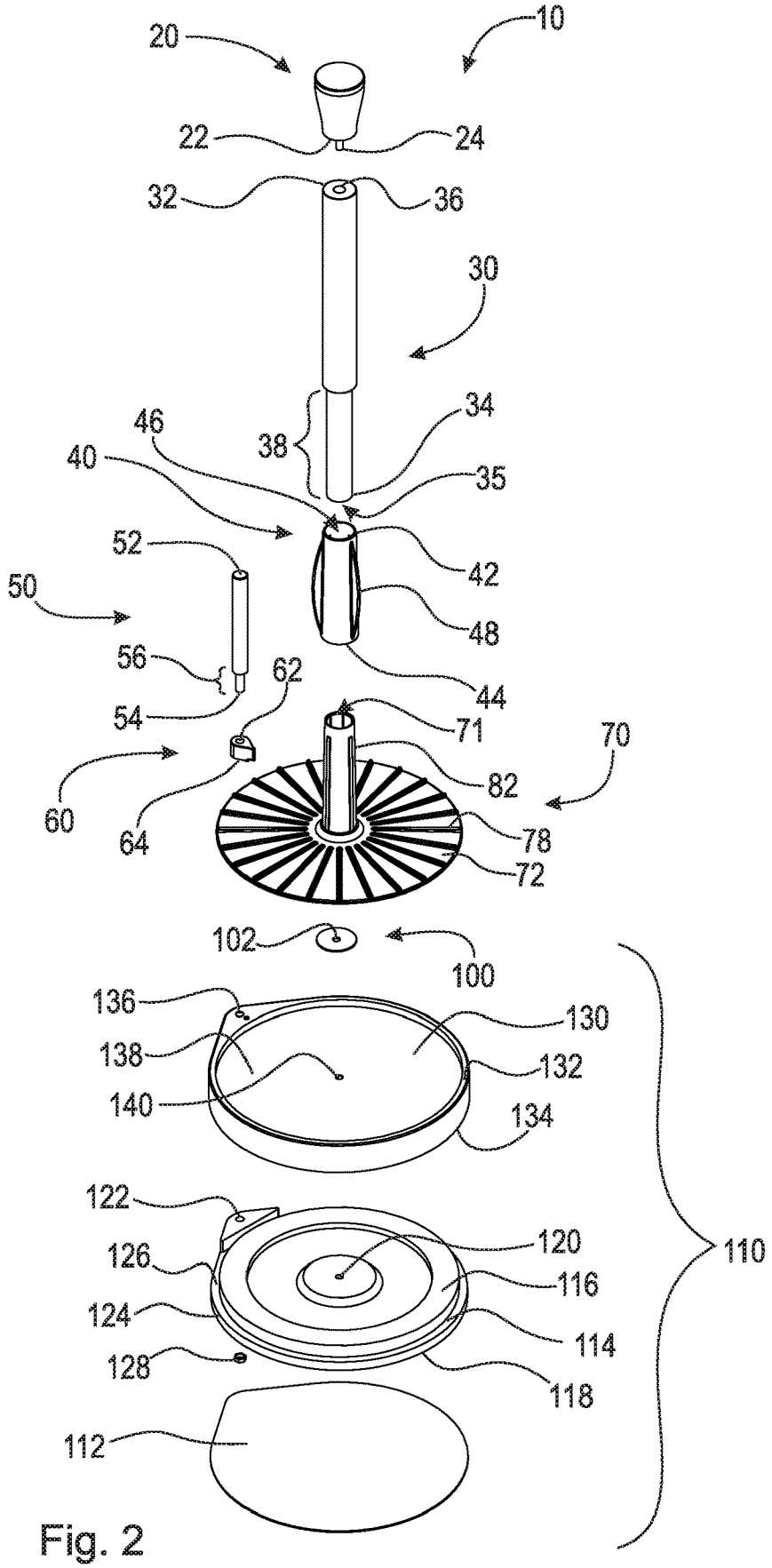
FIG. 2 is an exploded perspective view of the dispenser shown in FIG. 1A.
Figure 3A:
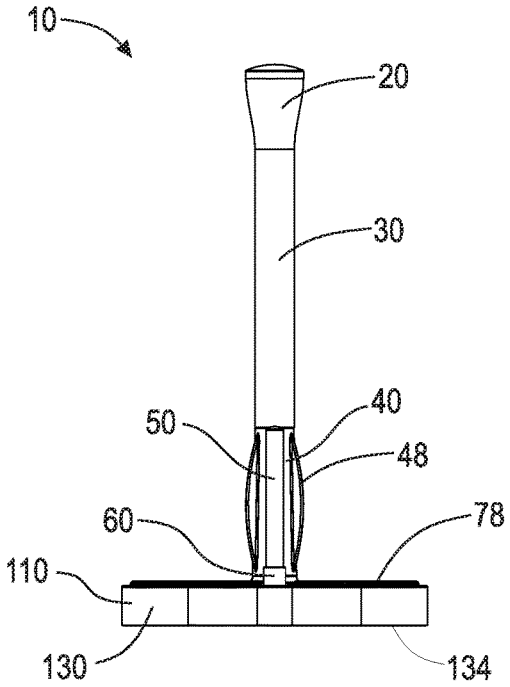
FIG. 3A is a front elevational view of the dispenser shown in FIG. 1A.
Figure 3B:
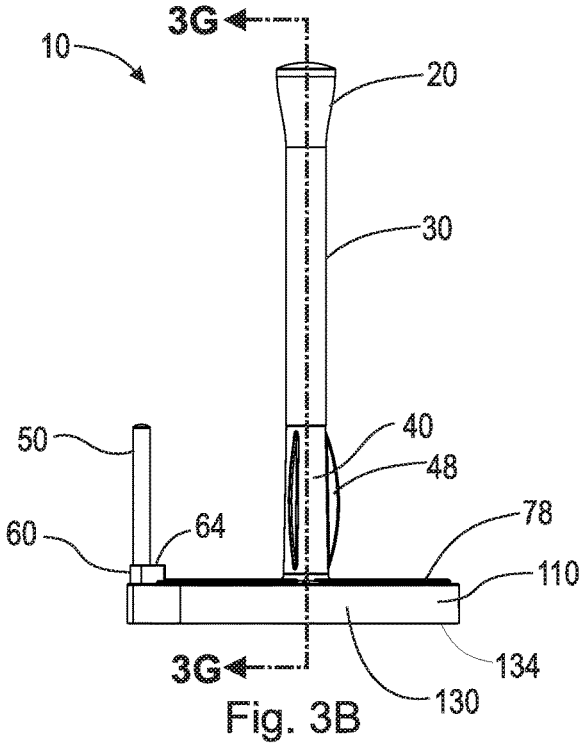
FIG. 3B is a right side elevational view of the dispenser shown in FIG. 1A.
Figure 3C:
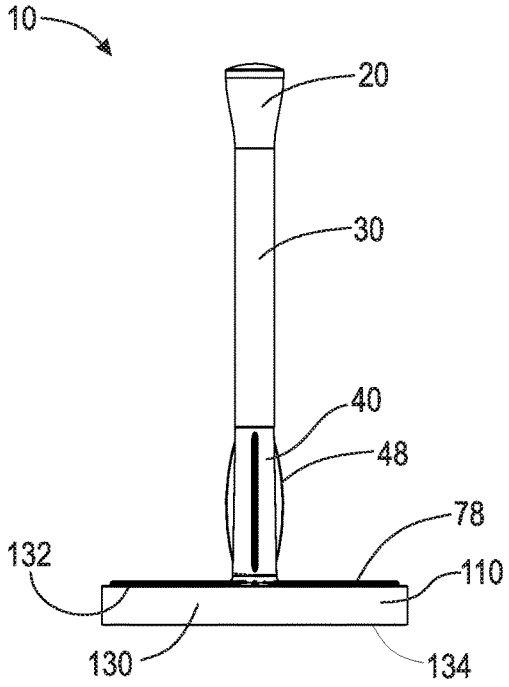
FIG. 3C is a rear elevational view of the dispenser shown in FIG. 1A.
Figure 3D:
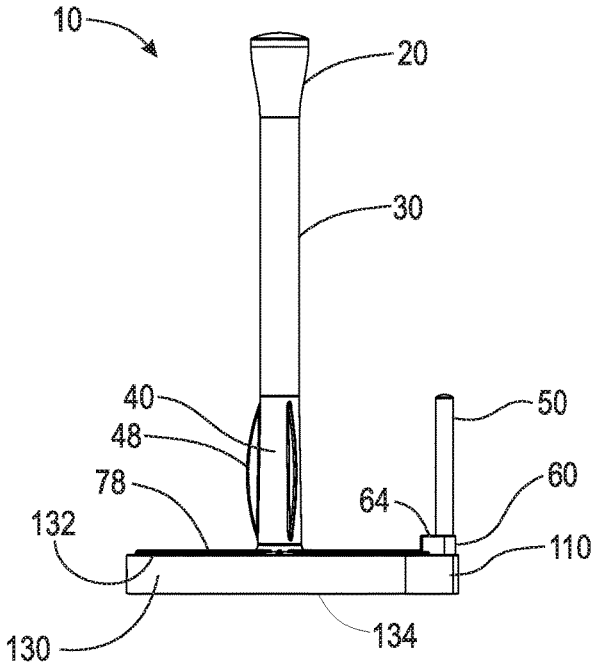
FIG. 3D is a left side elevational view of the dispenser shown in FIG. 1A.
Figure 3E:
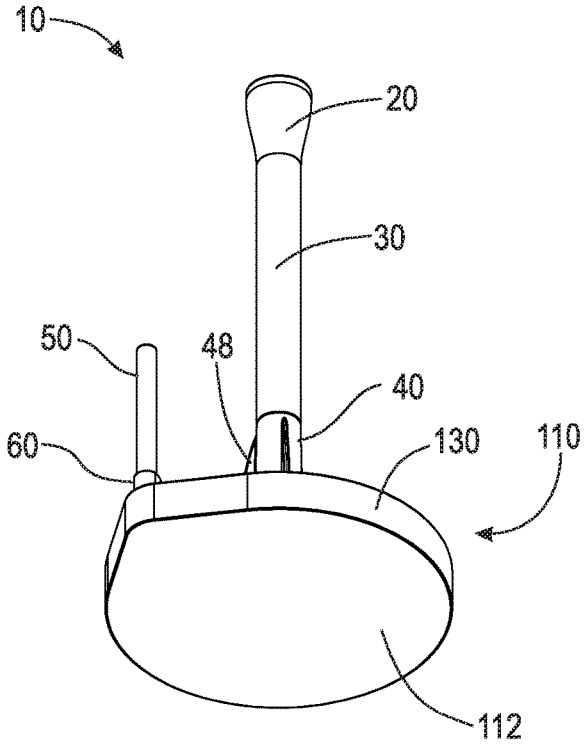
FIG. 3E is a bottom perspective view of the dispenser shown in FIG. 1A.
Figure 3F:
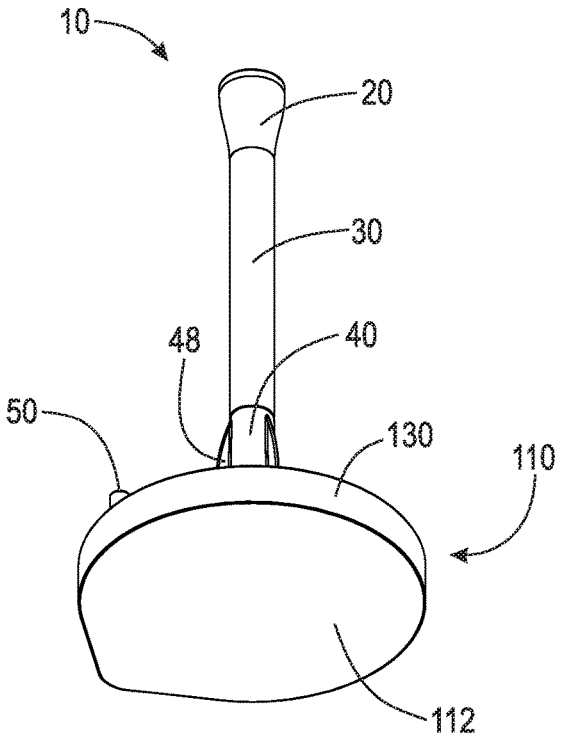
FIG. 3F is a bottom perspective view of the dispenser shown in FIG. 1A.
Figure 3G:
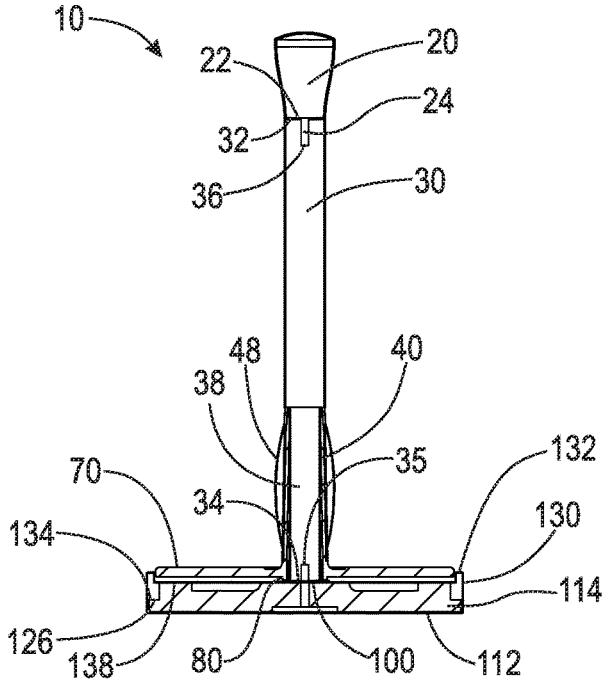
FIG. 3G is a cross-sectional view of the dispenser taken generally along line 3G-3G in FIG. 3B.

Referring now to the figures, FIG. 1A is a top perspective view of dispenser 10. FIG. 1B is a top perspective view of dispenser 10. FIG. 2 is an exploded perspective view of dispenser 10. FIG. 3A is a front elevational view of dispenser 10. FIG. 3B is a right side elevational view of dispenser 10. FIG. 3C is a rear elevational view of dispenser 10. FIG. 3D is a left side elevational view of dispenser 10. FIG. 3E is a bottom perspective view of dispenser 10. FIG. 3F is a bottom perspective view of dispenser 10. FIG. 3G is a cross-sectional view of dispenser 10 taken generally along line 3G-3G in FIG. 3B. Dispenser 10 generally comprises top 20, post 30, mount 40, post 50, flapper 60, rotatable base 70, and stationary base 110. The following description should be read in view of FIGS. 1A-3G.

Top 20 comprises surface 22 and screw 24 extending therefrom. Top 20 is arranged to threadably engage post 30 to axially lock a roll of material thereon. In some embodiments, top 20 is at least partially cylindrical. In some embodiments, top 20 is frusto-conical. Screw 24 is rotatably connected to surface 22. Screw 24 may be a bolt or screw. It should be appreciated that any suitable means for connecting top 20 to post 30 may be used, and that this disclosure should not be limited to a threaded engagement (e.g., screw or bolt).

Post 30 is generally cylindrical and comprises end 32 and end 34. Post comprises hole 36 arranged in end 32 and hole 35 arranged in end 34. Hole 36 is operatively arranged to engage screw 24 of top 20, and as such, may be threaded. Hole 35 is operatively arranged to engage a bolt or screw which passes up through holes 120 and 140 of stationary base 110 and through-bore 102 of washer 100, and secure post 30 to stationary base 110. In some embodiments, end 34 comprises a screw or bolt secured thereto (instead of a hole), wherein said screw or bolt engages a threaded hole in stationary base 110 to secure post 30 to stationary base 110. Post 30 may comprise section 38 proximate end 34 which has a reduced diameter. Section 38 is arranged to rotatably engage vertical member 82 of rotatable base 70. In some embodiments, post 30 comprise a constant outer diameter.

Stationary base 110 generally comprises grip 112, weight 114, and cover 130. Weight 114 comprises top surface 116 and bottom surface 118. Top surface 116 comprises hole 120 and hole 122. Weight 114 may further comprises flange 124 having surface 126.

Cover 130 comprises top surface 132, bottom surface 134, and recessed surface 138. Top surface 132 comprises hole 136. Recessed surface 138 comprises hole 140. Cover 130 is arranged to enclose or cover weight 114. In some embodiments, weight 114 is arranged completely within cover 130. In some embodiments, weight 114 is partially arranged within cover 130. In some embodiments, bottom surface 134 of cover 130 is secured to surface 126 of flange 124. Weight 114 may be secured to cover 130 using any suitable means, for example, adhesives, bolts, screws, rivets, nails, soldering, welding, etc. When stationary base 110 is assembled, hole 140 is aligned with hole 120 and hole 136 is aligned with hole 122. As previously discussed, in some embodiments a bolt or screw is inserted up through hole 120 (the head of which is arranged axially between grip 112 and weight 114) and hole 140 and threadably engages hole 35 to secure post 30 to stationary base 110. In some embodiments, hole 120 is threaded and post 30 comprises a screw or bolt that extends from end 34 and threadably engages hole 120 to secure post 30 to stationary base 110. The weighted stationary base 110 ensures that when the user pulls to rip a sheet of material from the roll of material that dispenser 10 does not easily move and/or remains stationary. Grip 112 is connected to bottom surface 118 via any suitable means, for example, adhesives, bolts, screws, rivets, nails, soldering, welding, etc. Grip 112 is operatively arranged to provide friction between dispenser 10 and the surface it is arranged on. For example, grip 112 may comprise rubber, foam, polymer, or some other material that provides an increased coefficient of friction between bottom surface 118 and a surface (e.g., counter top or table surface). In some embodiments, bottom surface 118 comprises a grip material.

Post 50 is a cylindrical rod comprising end 52 and end 54. End 54 is arranged to engage hole 136 of cover 130. Post 50 may comprise section 56 proximate end 54 which has a reduced diameter. In some embodiments, post 50 is non-rotatably secured in hole 136 via a press fit, threaded engagement, welding, soldering, adhesives, etc. In some embodiments, section 56 extends through holes 136 and 122 and is secured to stationary base 110 via nut 128. Post 50 helps the user tear a sheet of material from the roll of material and help prevent the roll of material from unraveling.

Flapper 60 is arranged on post 50 proximate end 54. Flapper 60 comprises through-bore 62 which is arranged to engage section 56. Flapper 60 further comprises portion 64 which is operatively arranged to engage ribs 78 of rotatable base, as will be discussed in greater detail below. Flapper 60 is preferably non-rotatably connected to post 50. In some embodiments, flapper 60 is at least partially rotatable with respect to post 50. Flapper 60 may comprise an elastic material such that portion 64 flexes or bends as rotatable base 70 rotates and ribs 78 interfere therewith, and then resume its original shape.

Figure 4A:
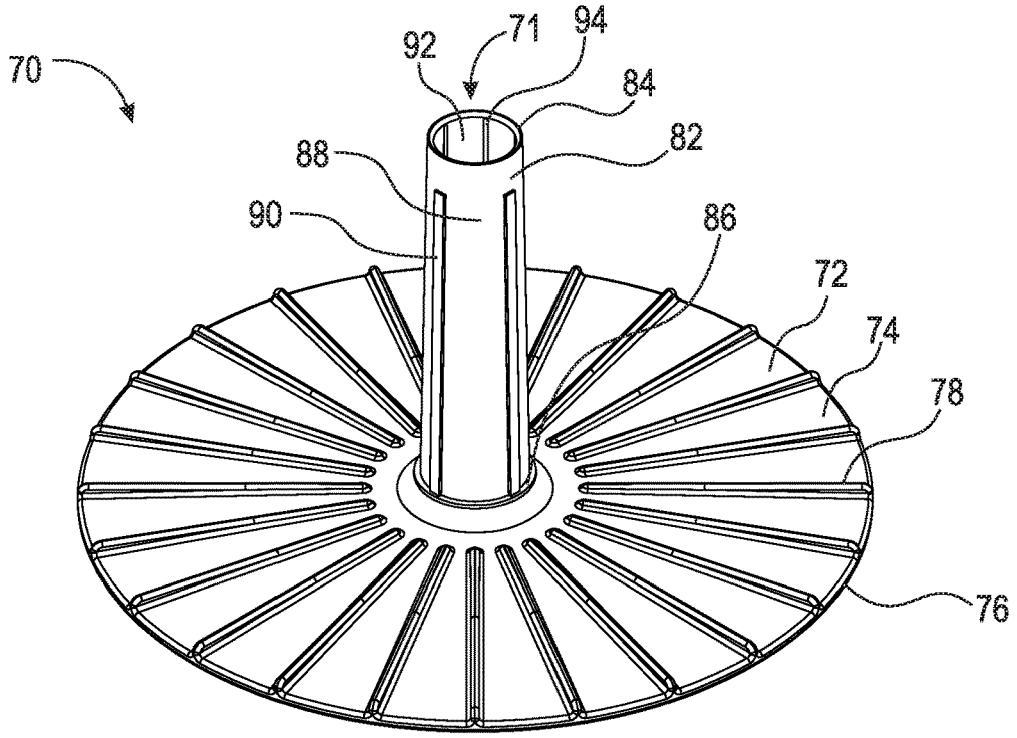
FIG. 4A is a top perspective view of a rotatable base as shown in FIG. 1A.
Figure 4B:
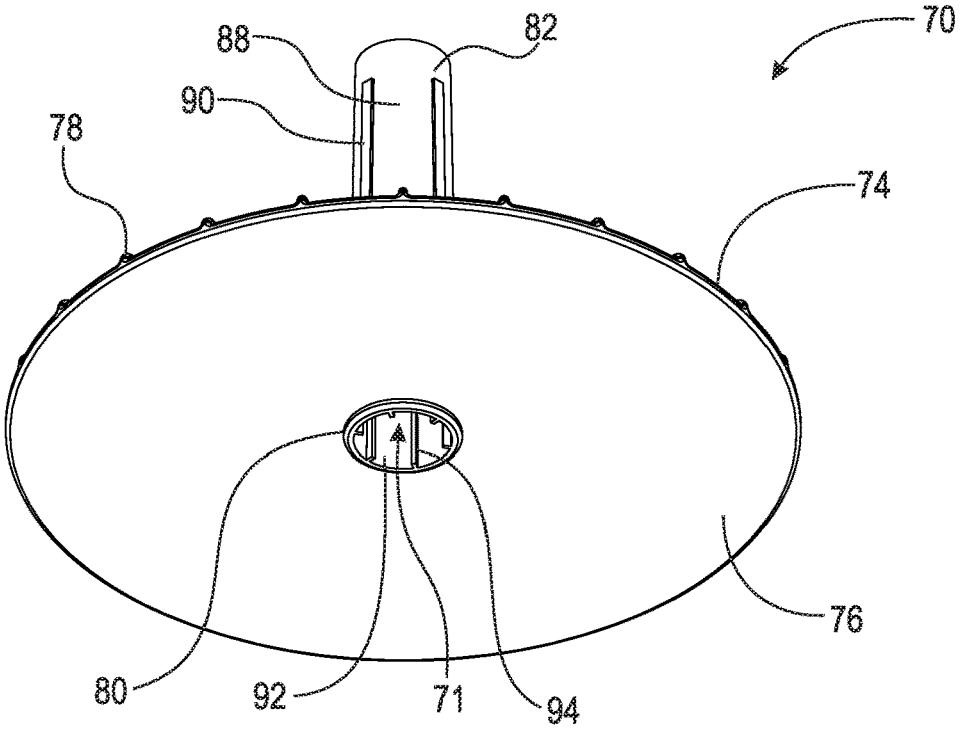
FIG. 4B is a bottom perspective view of the rotatable base shown in FIG. 4A.
Figure 4C:
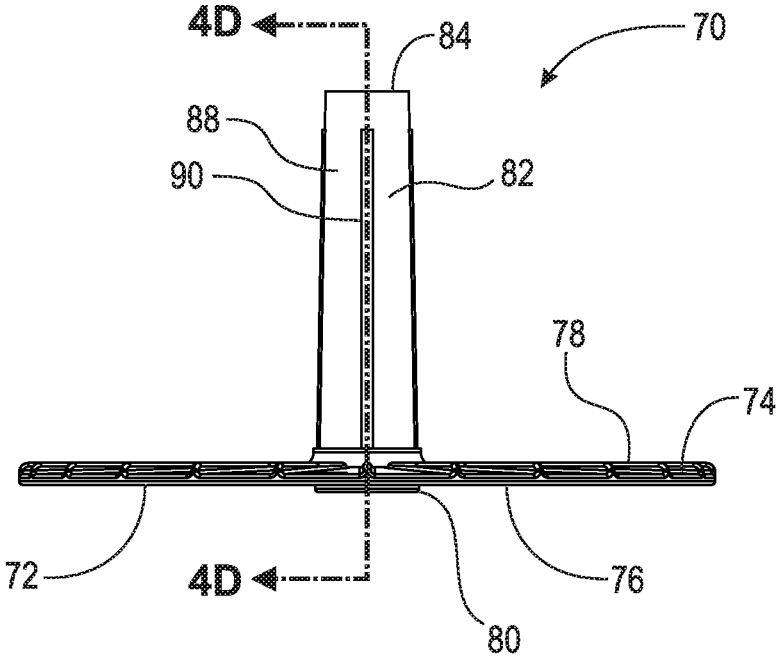
FIG. 4C is a side elevational view of the rotatable base shown in FIG. 4A.

FIG. 4A is a top perspective view of rotatable base 70. FIG. 4B is a bottom perspective view of rotatable base 70. FIG. 4C is a side elevational view of rotatable base 70.

Figure 4D:
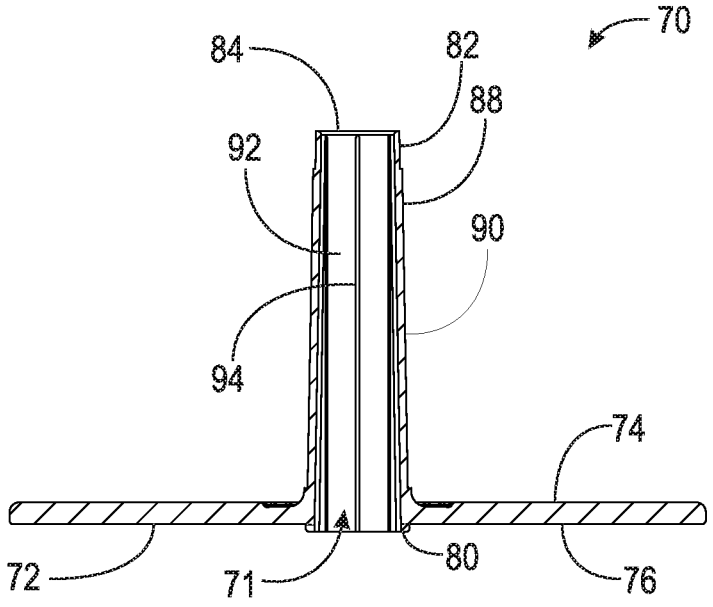
FIG. 4D is a cross-sectional view of the rotatable base taken generally along line 4D-4D in FIG. 4C.
Figure 4E:
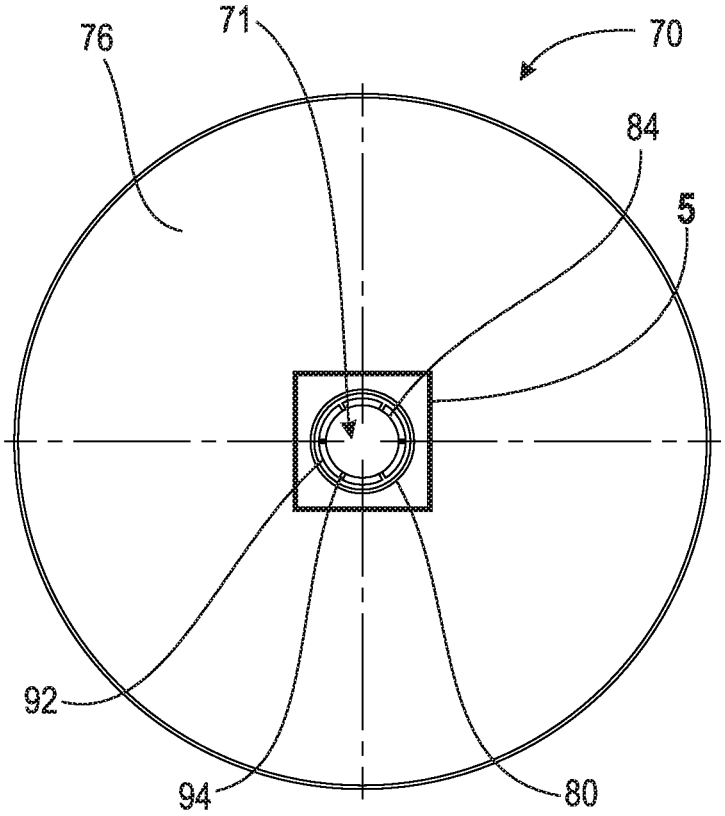
FIG. 4E is a bottom elevational view of the rotatable base shown in FIG. 4A; and, FIG. 5 is a detail view of the rotatable base taken generally along detail 5 in FIG. 4E.
Figure 5:
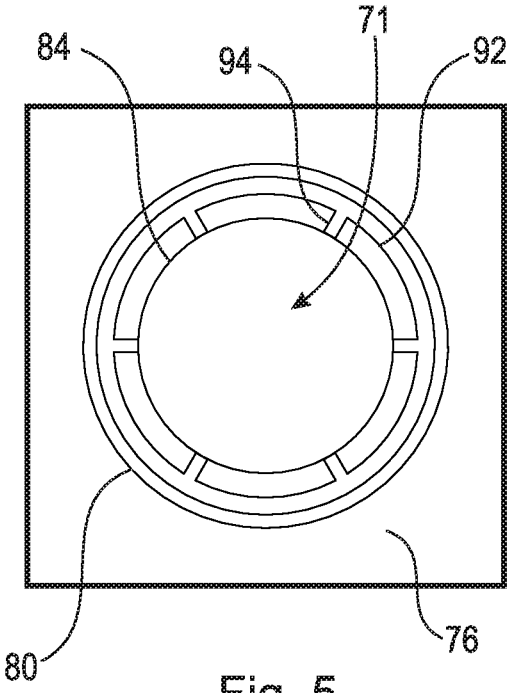

FIG. 4D is a cross-sectional view of rotatable base 70 taken generally along line 4D-4D in FIG. 4C. FIG. 4E is a bottom elevational view of rotatable base 70. FIG. 5 is a detail view of rotatable base 70 taken generally along detail 5 in FIG. 4E. Rotatable base 70 generally comprises disc 72, vertical member 82, and through-bore 71. The following descriptions should be read in view of FIGS. 1A-5.

Disc 72 is generally circular and comprises top surface 74 and bottom surface 76. Top surface 74 comprises one or more ribs 78 which are arranged circumferentially around disc 72. In the embodiment shown, each of one or more ribs 78 extends radially outward from proximate a center point of disc 72. Ribs 78 are arranged to engage portion 64 of flapper 60 to restrict the rotational displacement of rotatable base 70. Bottom surface 76 comprises ring 80 protruding therefrom. When dispenser 10 is assembled, disc 72 is arranged on recessed surface 138. Specifically, ring 80 is arranged on washer 100 and rotates relative to stationary base 110.

Vertical member 82 is generally a cylindrical tube comprising top 84 and bottom 86. Vertical member 82 is fixedly secured to disc 72 at bottom 86. In some embodiments, vertical member 82 is frusto-conical, which aids in non-rotatably connecting mount 40 thereto (i.e., as mount 40 is slid down vertical member 82 an interference fit is formed). Through-bore 71 extends from top 84, down through vertical member 82 and disc 72 to bottom surface 76. Vertical member further comprises radially outward facing surface 88 and radially inward facing surface 92. Radially outward facing surface 88 comprises one or more ribs 90 operatively arranged to engage the radially inward facing surface (or through-bore 46) of mount 40. Ribs 90 extend axially along radially outward facing surface 88 from bottom 86 to, or proximate to, top 84. In some embodiments, dispenser 10 does not require mount 40, but rather vertical member 82 comprises one or more elastic fins to engage the roll of material and non-rotatable connect the inner tube of the roll of material to rotatable base 70. Radially inward facing surface 92 comprises one or more ribs 94. Ribs 94 extend axially along radially inward facing surface 92 or through-bore 71, from ring 80 to, or proximate to, top 84.

Mount 40 is generally a cylindrical tube comprising end 42, end 44, and through-bore 46 extending from end 42 to end 44. Mount 40 further comprises one or more fins 48. Fins 48 are preferably elastic and thus flexible. Through-bore 46 is arranged to non-rotatably engage vertical member 82 of rotatable base such that end 44 is arranged proximate bottom 86 and end 42 is arranged proximate top 84. When a roll of material is slid down post 30 from end 32 toward end 34, the inner tube of the roll of material engages with fins 48 so that the roll of material is non-rotatably connected to mount 40 and rotatable base 70.

To assemble dispenser 10, weight 114 is arranged within cover 130 and secured therein. Mount 40 is secured to vertical member 82 of rotatable base 70. Through-bore 46 is engaged around radially outward facing surface 88. Rotatable base 70 and mount 40 are then arranged on cover 130, specifically, disc 72 is arranged on recessed surface 138. Post 30 is secured to recessed surface 138 of cover 130 via any suitable means, as previously discussed. Section 38 passes through through-bore 71 and end 34 is secured to stationary base 110 thereby rotatably connecting rotatable base 70 and mount 40 to stationary base 110. Grip 112 is secured to bottom surface 118 of weight 114. Flapper 60 is arranged on post 50, and post 50 is secured to top surface 132 of cover 130 via any suitable means, as previously discussed. Portion 64 is pointed substantially radially inward such that it overlaps disc 72 and interferes with ribs 78. As rotatable base 70 rotates, ribs 78 engage portion 64 and deform flapper 60, which returns to its normal original shape once the interfering rib has passed. Lastly, top 20 is secured to post 30 at end 32. To assemble a roll of material on dispenser 10, top 20 is removed from post 30, and the roll of material is inserted on post 30 at end 32. The roll of material is slid down post 30 toward bottom 86 of rotatable base 70 and/or end 44 of mount 40. The inner tube of the roll of material interferes with fins 48 such that the roll of material is non-rotatably connected to rotatable base 70. Top 20 is then secured to end 32 of post 30 thereby axially locking the roll of material on post 30. It should be appreciated that the interference between flapper 60 and ribs 78 allows the rotation of rotatable base 70 and the roll of material to be better controlled. Specifically, flapper 60 slows the rotational speed of rotatable base 70. This is useful because it allows the user to easily tear sheets of the material from the roll with one hand.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 Dispenser
20 Top
22 Surface
24 Screw
30 Post
32 End
34 End
35 Hole
36 Hole
38 Section
40 Mount
42 End
44 End
46 Through-bore
48 Fins
50 Post
52 End
54 End
56 Section
60 Flapper
62 Through-bore
64 Portion
70 Rotatable base
71 Through-bore
72 Disc
74 Top surface
76 Bottom surface
78 Ribs
80 Ring
82 Vertical member
84 Top
86 Bottom
88 Radially outward facing surface
90 Ribs
92 Radially inward facing surface
94 Ribs
100 Washer
102 Through-bore
110 Stationary base
112 Plate
114 Weight
116 Top surface
118 Bottom surface
120 Hole
122 Hole
124 Flange
126 Surface
130 Cover
132 Top surface
134 Bottom surface
136 Hole
138 Recessed surface
140 Hole

What is claimed is:

1. A dispenser for rolled materials, comprising:

a first base;

a second base rotatably engaged with the first base, the second base including:

a disc including a top surface having one or more ribs arranged thereon; and, a vertical member connected to the top surface;

a first post connected to the first base; and, a second post connected to the first base, the second post including a flapper operatively arranged to engage the one or more ribs.

2. The dispenser as recited in claim 1, wherein the second base further comprises a first through-bore, and the first post extends through the first through-bore.

3. The dispenser as recited in claim 1, further comprising a mount arranged to be non-rotatably connected to the vertical member.

4. The dispenser as recited in claim 3, wherein the mount comprises a second through-bore, the vertical member arranged to extend at least partially through the second through-bore.

5. The dispenser as recited in claim 3, wherein the mount comprises one or more fins.

6. The dispenser as recited in claim 5, wherein the one or more fins comprise an elastic material.

7. The dispenser as recited in claim 3, wherein the mount is concentrically arranged around the vertical member.

8. The dispenser as recited in claim 1, further comprising a top removeably connected to the first post.

9. The dispenser as recited in claim 1, wherein the first base comprises a recessed surface, the disc being arranged on the recessed surface.

10. The dispenser as recited in claim 9, wherein the disc comprises a bottom surface having a ring which abuts against the recessed surface.

11. The dispenser as recited in claim 1, wherein the first base comprises a cover and a weight arranged within the cover.

12. The dispenser as recited in claim 1, further comprising a grip layer connected to the first base.

13. A dispenser for a roll of material having an inner tube and material wrapped around the inner tube, the dispenser comprising:

a first base including a recessed surface;

a second base rotatably engaged with the first base, the second base including:

a disc including a top surface having one or more ribs arranged thereon and a bottom surface arranged on the recessed surface;

a vertical member connected to the top surface and arranged to be non-rotatably connected to the inner tube; and, a first through-bore;

a first post extending through the first through-bore and connected to the first base; and, a second post connected to the first base, the second post including a flapper operatively arranged to engage the one or more ribs, wherein the top surface is axially arranged between the flapper and the recessed surface.

14. The dispenser as recited in claim 13, further comprising a mount arranged to be non-rotatably connected to the vertical member, wherein the inner tube is arranged to be non-rotatably connected to the mount.

15. The dispenser as recited in claim 14, wherein the mount comprises a second through-bore, the vertical member arranged to extend at least partially through the second through-bore.

16. The dispenser as recited in claim 14, wherein the mount comprises one or more fins operatively arranged to engage the inner tube.

17. The dispenser as recited in claim 16, wherein the one or more fins comprise an elastic material.

18. The dispenser as recited in claim 13, further comprising a top removeably connected to the first post, the top arranged to axially lock the roll of material on the first post.

19. The dispenser as recited in claim 13, wherein the bottom surface comprises a ring which abuts against the recessed surface.

20. The dispenser as recited in claim 13, wherein the flapper is non-rotatably connected to the first base and comprises an elastic material.

* * * * *